US005145432A

United States Patent [19]

Midland et al.

[11] Patent Number: 5,145,432

[45] Date of Patent: Sep. 8, 1992

[54] OPTICAL INTERPROGATION SYSTEM FOR USE IN CONSTRUCTING FLAT TENSION SHADOW MASK CRTS

[75] Inventors: Richard W. Midland, Inverness; Boris Rozansky, Buffalo Grove; Thomas W. Tepe, Oak Park, all of Ill.

[73] Assignee: Zenith Electronics Corporation, Glenview, Ill.

[21] Appl. No.: 799,590

[22] Filed: Nov. 27, 1991

[51] Int. Cl.[5] ..... H01J 9/00; H01J 9/42

[52] U.S. Cl. ..... 445/3; 445/30; 445/64; 445/68; 358/107

[58] Field of Search ..... 445/3, 30, 4, 64, 68; 358/107

[56] References Cited

U.S. PATENT DOCUMENTS 4,556,902 12/1985 Krufka ..... 358/107
4,711,579 12/1987 Wilkinson ..... 356/394 X
4,717,955 1/1988 Krufka ..... 358/107
4,834,686 5/1989 Kautz et al. ..... 445/30
4,902,257 2/1990 Adler et al. ..... 445/30 X
4,980,570 12/1990 Yasunaga et al. ..... 356/375 X
4,989,082 1/1991 Hopkins ..... 358/101
4,998,901 3/1991 Adler et al. ..... 445/30 X

*Primary Examiner*—Kenneth J. Ramsey

[57] ABSTRACT

An optical interrogation system has camera arrays useful for determining the locations of a plurality of apertures on a flat tension shadow mask and fiducial marks on a screened front panel of a CRT. The system determines the actual location of apertures or fiducial marks with respect to the cameras' field of view. By eliminating gray scaling, the processing only for light/dark transitions in single-bit binary valued pixels from each of the cameras in parallel, i.e., simultaneously, remarkable rapidity is obtained in the interrogation of widely spaced fields with minimal hardware. The system may also be used to interrogate mask support surfaces on the front panel prior to welding the mask thereto.

23 Claims, 9 Drawing Sheets

OPTICAL INTERPROGATION SYSTEM FOR USE IN CONSTRUCTING FLAT TENSION SHADOW MASK CRTS

RELATED APPLICATIONS

This application is related to, but not dependent upon, U.S. Application Ser. No. 07/710,738, filing date, May 29, 1991, commonly owned herewith.

BACKGROUND OF THE INVENTION

The invention applies to the manufacture of flat tension mask color cathode ray tubes (CRTs). More specifically, the invention provides interrogation means for achieving registration of the aperture patterns of flat tension shadow masks and related cathodoluminescent screens. The interrogation means of the present invention could also be used to inspect these light-transmitting work pieces in preparation for subsequent operations in the CRT manufacturing process In particular, the invention relates to a portion of the process steps employed in the manufacture of the front glass panel assembly of a flat tension mask color cathode ray tube. The complete front glass panel assembly includes a glass front panel, a shadow mask support structure on the inner surface of the front glass panel and a tensed foil shadow mask affixed to the support structure.

In this specification, the terms "grille" and "screen" are used, and apply generally to the pattern on the inner surface of the front panel. The grille, also known as the black surround, or black matrix, is widely used to enhance contrast. It is applied to the panel first. It comprises a dark coating on the panel in which holes are formed to permit passage of light, and over which the respective colored-light-emitting phosphors are deposited to form the screen.

The holes in the grille must register with the columns, or "beamlets", of electrons passed by the holes or slots in the shadow mask. This is the primary registration requirement in a grille-equipped tube; the phosphor deposits may overlap the grille holes, hence their registration requirements are less precise.

In tubes without a grille, on the other hand, it is the phosphor deposits which must register with the columns of electrons. The word "screen", or "screened" when used in the context of the faceplate, therefor includes the grille where a grille is employed, as well as the phosphor deposits when there is no grille.

Historically, color cathode ray tubes have been manufactured by requiring that a shadow mask dedicated to a particular panel follow the panel through various states of the manufacturing process. Such a procedure is more complex than might be obvious; a complex conveyor system is needed to maintain the marriage of each mask assembly to its associated panel throughout the manufacturing process. In several stages of the process the panel must be separated from the mask and the mating shadow mask cataloged for later reunion with its panel mate.

With the recent commercial introduction of the flat tension mask cathode ray tube, many process problems related to the curvature of the mask and panel have been alleviated or reduced. Necessarily, however, initial production of flat tension mask tubes has been based on continued use of the proven technology of mating a dedicated mask to a specific front glass panel throughout the manufacturing process. However, because the flat tension mask requires tension forces during the manufacturing process as well as after installation in a tube, somewhat cumbersome in-process support frames become necessary. These introduce complexity and expense in the manufacture of color cathode ray tubes of the tension mask type.

Thus, the desirability of simplifying the conventional production process remains as great as ever in the manufacture of cathode ray tubes of the flat tension mask type.

It has been recognized that color tube manufacture would be simplified if any mask could be registered with any screen (commonly termed an "interchangeable" mask), so that masks and screens would no longer have to be individually mated. Interrogation of the mask and screen to determine registration before assembly of the mask to the rest of the front panel assembly is, therefore, highly desirable.

U.S. Pat. No. 4,902,257; and its continuation-in-part, U.S. Pat. No. 4,973,280; describe and illustrate a variety of methods and apparati for registering a flat tension mask to a faceplate mounted screen with technology particularly adapted to achieve registration of interchangeable masks and faceplates. U.S. Ser. No. 07/710,738 discloses a complete system for registering the shadow mask to the screen and welding the mask to the faceplate.

The present invention follows many of the principles disclosed in these references and proceeds further bringing these technologies to commercial production. The complete manufacturing system disclosed by the above cited '738 application for mating a undedicated flat tension mask to a face panel mounted screen, includes: a) faceplate and mask loading, b) automatic shuttling of face panel and mask modules which carry the panel and mask alternately to a location beneath the assembly station, c) automatic lifting of faceplate and mask modules from the shuttle upwardly into the assembly station where they are registered with production accuracies, d) screen position interrogation with respect to the panel module, e) mask interrogation, and f) comparison of the tensed mask with respect to the panel module so that the location of the aperture array in the mask can be determined with respect to the actual location of the screen on the face panel in order to achieve true production registration consistency.

The term "registration" as used in these references and this application ultimately is used to describe the alignment of apertures in the mask with phosphor spots o the faceplate-carried screen, but to achieve that end it is necessary to properly align the panels and masks both with respect to their transport modules and the assembly station. The definition of registration herein, when indicated, encompasses these preliminary alignments as well.

In order to achieve production accuracies in an interchangeable panel-mask system, it is necessary to interrogate screen and mask locations for verification and registration control. According to the Ser. No. 710,738 preferred embodiment, these interrogation functions are provided by camera arrays carried on the mask and panel modules. The camera arrays thus travel with the modules from their respective loading stations to the assembly station, or alternatively, the interrogation camera arrays may be physically separate from the modules and moved into position, as needed, by transport means. The camera arrays must then be provided with positioning means to assure their constant placement. In the embodiments disclosed in the '738 application, the interrogation functions are provided by microtelevision-type cameras.

Due to the very precise sub-mil positioning requirements of a CRT mask registration system, movement of interrogation cameras during interrogation must be kept to a minimum to allow for precise determination of plan r coordinates. However, several widely spaced areas of the mask and panel must be viewed at high resolutions in order to determine registration. If one then uses multiple cameras to affect the proper range of fields to be interrogated at the proper resolution; one must overcome the problem of processing the information from multiple cameras in a small enough time period to make the interrogation system useful in a production environment.

Within the present interchangeable shadow mask environment, the present invention does this by utilizing only single bit binary values to represent pixels and then concurrently processing each camera's single bit values to evaluate the fields of view of the plurality of interrogation cameras simultaneously. By utilizing this approach great accuracy is attained at high production speed with minimal hardware. No reference or combination of references known to the applicant teaches these advantages.

Other references of interest may include: U.S. Pat. Nos: 4,525,735 to Krufka, 4,556,902 to Krufka, 4,665,429 to Krufka, 4,684,982 to Krufka, 4,717,955 to Krufka, 4,834,686 to Kautz, 4,980,570 to Yasunaga et al., 4,711,579 to Wilkinson, 4,989,082 to Hopkins,

OBJECTS OF THE INVENTION

It is an object of the present invention to provide an automated system that includes an assembly system for flat tension masks and faceplates including a transport shuttle for conveying a face panel module and a mask module alternately to an assembly station where the mask and panel are registered to one another and joined, with a minimum of part movement, through the use of a system for interrogating light-transmitting objects on a stationary work piece to determine the positions of the objects. Light transmission as used herein includes reflected light.

It is a further object to provide such a system specifically for the interrogation of color CRT shadow masks and screen and to make the system fast and inexpensive for use in a production environment.

It is a further object to provide such a system for the interrogation of a flat tension mask front panel assembly including any or all of the mask, screen, and mask support surfaces in order to obtain data necessary for joining the mask to the mask support surfaces in registry with the screen.

It is a further object to make such an interrogation system available as an inspection tool for use in combination with various other CRT manufacturing processes.

BRIEF DESCRIPTION OF THE DRAWINGS

Other attendant advantages will be more readily appreciated as the invention becomes better understood by reference to the following detailed description and compared in connection with the accompanying drawings in which like reference numerals designate like parts throughout the figures. It will be appreciated that the drawings may be exaggerated for explanatory purposes.

DESCRIPTION OF THE PREFERRED EMBODIMENT

Figure 1:
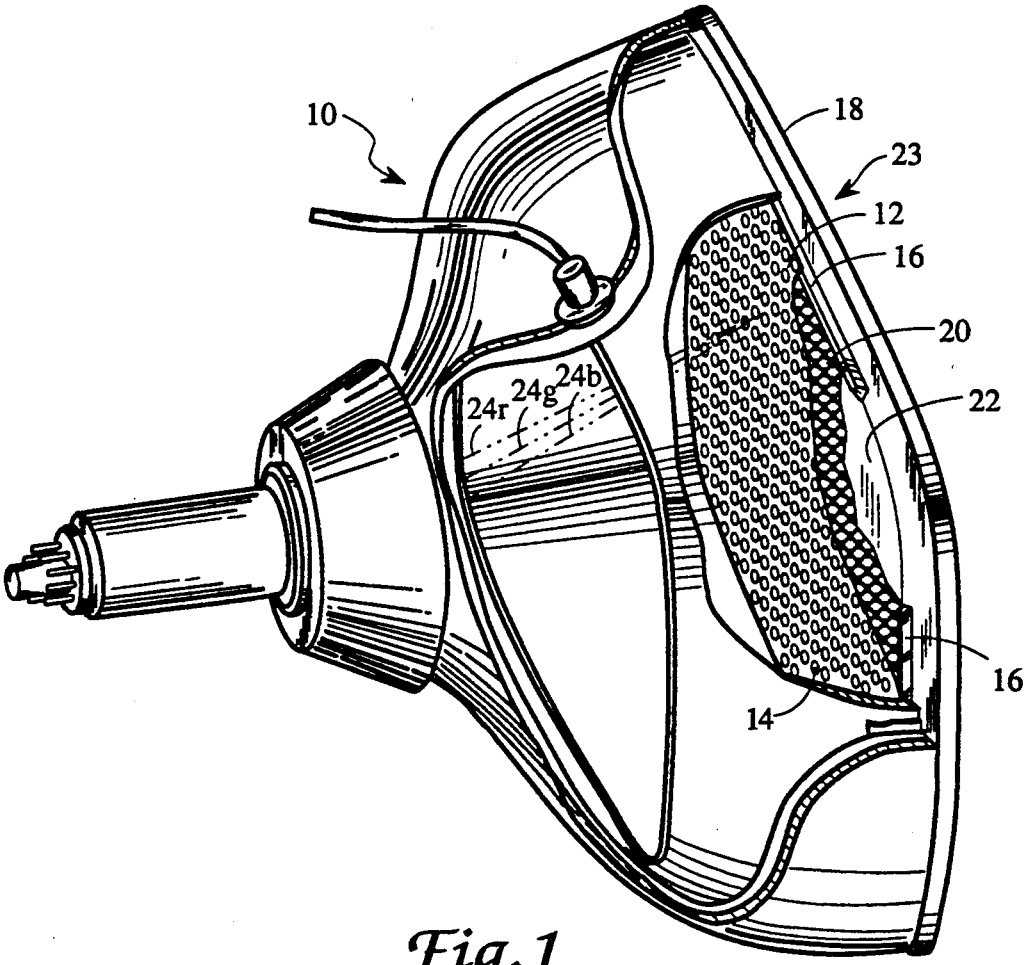
FIG. 1 is a perspective cutaway view of a flat tensioned mask CRT.

As seen in FIG. 1, a flat tension mask (FTM) color cathode ray tube (CRT) 10, comprises a shadow mask 12 having a pattern of apertures 14. The mask 12 is affixed under tension to mask support structures 16, or rails, which are affixed to the front panel, or faceplate 18 and which surround the phosphor screen 20 applied to the interior surface 22 of the faceplate. The faceplate with screen and mask supports attached will be referred to as a "panel assembly" 23. As previously stated, the mask apertures 14 must register with the screen 20 to allow placement of the electron beams 24 *r,g,b* on the proper phosphor elements to create the intended display. It is not deemed necessary to describe in detail the functioning of the CRT 10, as this is well known in the art.

Figure 2:
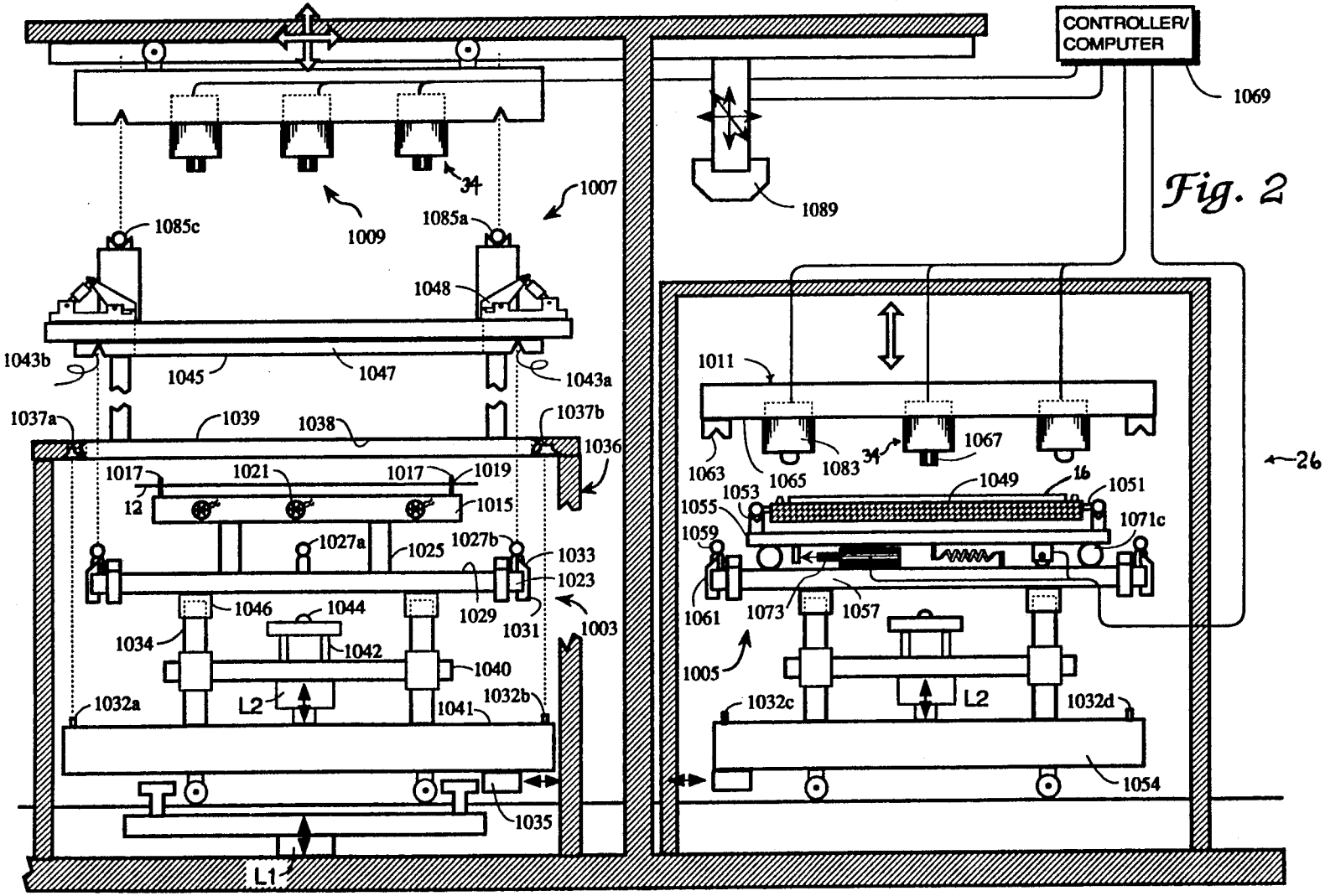
FIG. 2 illustrates a interchangeable mask tensioning and welding machine incorporating the present invention.

As seen in FIG. 2, and more fully described and claimed in the above referenced U.S. application Ser. No. 07/710,738, an apparatus 26 for automatic tensioning of the mask 12, registry of the screen (not shown) on the faceplate 18 with the mask 12 and welding of the mask 12 to the mask support structures 16, utilizes an optical interrogation system according to the present invention. The interrogation system comprises two spaced-camera arrays 1009,1011 for interrogation of the mask 12 and screened panel 1049, respectively, and associated digital processing equipment 1069 for intelligence and coordination of the process.

SYSTEM OVERVIEW

Figure 3:
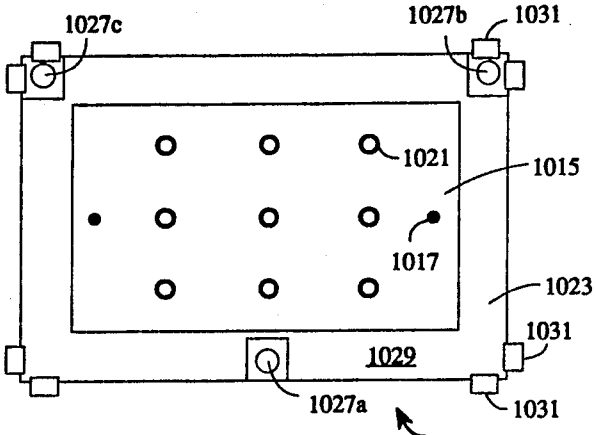
FIG. 3 is a top view of the mask module first stage of the embodiment of FIG. 2.

Referring now to the mask module 1003 of FIG. 2, also seen in top view in FIG. 3, the mask 12 is positioned on the mask module first stage 1015 by the mask positioning pins 1017 which extend through mask position holes 1019 in the mask 12. The mask 12 is lit for interrogation purposes by LED's 1021 carried in the mask module first stage 1015. The mask module first stage 1015 is fixedly positioned to, and above, the mask module second stage 1023 by means of columns 1025. The mask module second stage 1023 has three registry balls 1027*a, b, c* secured to its upper surface 1029 and spaced approximately 120° apart.

Two corner positioning units 1031 are fastened on adjacent edges of each corner the mask module second stage 1023 and present inclined faces 1033 upwardly to aid in-gross module positioning in the assembly station 1007, as further explained below.

In operation, the mask 12 is loaded on the mask module 1003 when the mask module is positioned outside the assembly station 1007. A transport system 1035, which has a two position shuttle, described in the '738 application, brings the mask module 1003 into alignment underneath the assembly station 1007 and over the primary, or gross, lifter L1.

The primary lifter Ll elevates the entire module. Should the module 1003 be mispositioned, corner positioners 1033 will contact the edges of the assembly station frame 1036 at lower assembly station plate aperture 1038 thus shifting the module 1003 on the primary lifter L1 to a centered position within the assembly station 1007.

The mask module base platform 1041 is provided with a pair of opposed registration pins 1032*a, b* on its upper surface which respectively mate with a hole 1037*a* and slot 1037*b* formed in the lower assembly station plate 1039. Through mating of these elements 1037*a, b* and 1032*a, b* initial registration of the mask module 1003 in the assembly station 1007 is achieved which is very close to the ultimate registration desired.

In order to ultimately register the mask module 1003 in the assembly station 1007 to the tolerances required, a fine positioning lifter is employed. The secondary, or fine, lifter L2 carried on the module base platform 1041 elevates the third module stage 1040, which in turn contacts the second stage 1023 through a platform 1042 mounted on the third stage 1040. The platform 1042 carries a spring-loaded ball bearing 1044.

Figure 4:
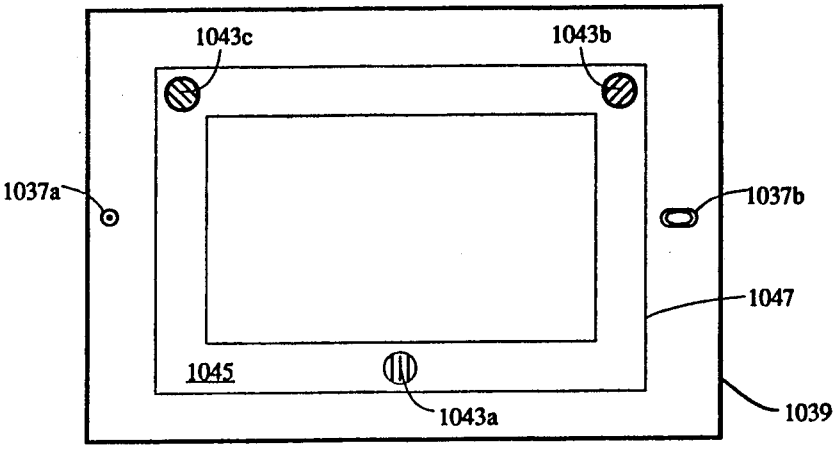
FIG. 4 is a bottom view of the assembly station registration features of the embodiment of FIG. 2.

Cups 1046 are attached to the second stage underside and overlay posts 1034 running between the base platform 1041 and the third and second module stages, 1040, 1023, respectively. As the spring-loaded ball bearing 1044 contacts the second stage 1023, the second stage floats horizontally, to the extent of the spacing between the cups 1046 and the posts 1034. The first and second mask module stages 1015 and 1023, respectively, are thus raised to the operating height of the assembly station 1007; bringing the mask module registration balls 1027 *a,b,c* into a constant position determined by three V-grooves 1043 *a,b,c* (FIG. 4) located on the underside 1045 of the assembly station platform 1047.

The mask 12 can then be grasped and supported by tensioning clamps 1048 in the predetermined position as determined by the registry of the assembly station V-grooves 1043 a,b,c and the mask module registry balls 1027 *a,b,c,* and the mask positioning pins 1017. The mask module 1003 can then be withdrawn from the assembly station.

Concurrently with the above-described mask-loading procedure, the screened panel 1049 is loaded into the panel module 1005. The panel 1049 has previously described fiducial marks FIG. 10A which relate directly to the phosphor screen configuration, ie., placement, size, shape, thereon.

Figure 5:
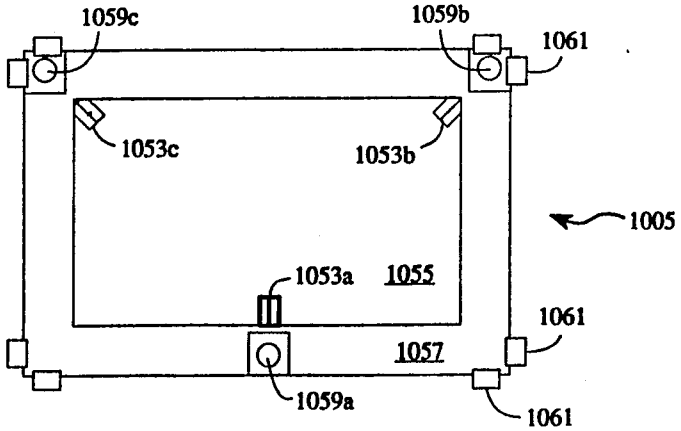
FIG. 5 is a top view of the first and second panel module stages of the embodiment of FIG. 2.

As seen in FIG. 2, the panel 1049 has panel positioner balls 1051 glued thereon which mate with V-grooves 1053 *a,b,c* (FIG. 5) located on the first stage 1055 of the panel module 1005, for predetermined positioning of panels, as is known in the art.

The panel module first stage 1055 is movably supported on the panel module second stage 1057, as further explained below, to affect in-gross movements of the panel.

The panel module second stage 1057 has located thereon registry balls 1059 *a,b,c* and corner positioning units 1061 identical in form and placement to the registry balls 1027 *a,b,c* and corner positioners 1031 of the mask module second stage 1029. Thus, the first and second panel modules stages 1055, 1057 define a panel registration system. The panel module base platform 1054 has base platform positioning pins 1032*c, d* identical in form and function to those on the mask module 1003.

Figure 6:
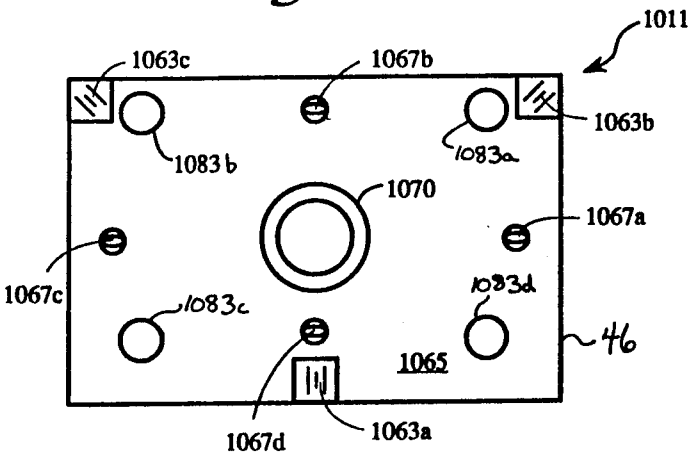
FIG. 6 is a bottom view of the panel interrogation camera array of the embodiment of FIG. 2.

The panel interrogation camera array 1011 has three V-grooves 1063 *a,b,c* (FIG. 6) located on the underside 1065 thereof for meeting with the panel module registry balls 1059 *a,b,c.*

After the panel 1049 is positioned on the panel module first stage 1055, the panel interrogation camera array 1011 is lowered into predetermined position on the panel module 1005. Four fiducial mark cameras 1067 *a,b,c,d* carried on the array 1011 are thereby aimed at the four fiducial marks (60, FIG. 10A) whose configuration relates directly to the configuration of the screen on the panel. Such direct relation may be achieved by forming the fiducial marks with the same method and apparatus used to apply the screen. The fiducial marks may be illuminated as by light 1070 or beneath the panel with LEDs (not shown) as described . The fiducial marks will be read and entered into a computer/controller 1069 which determines the screen configuration corresponding to the fiducial mark reading in order to determine the type of stretching for the mask in the assembly station and/or any displacement of the panel required to bring the screen axes and mask axes into alignment.

Figure 8:
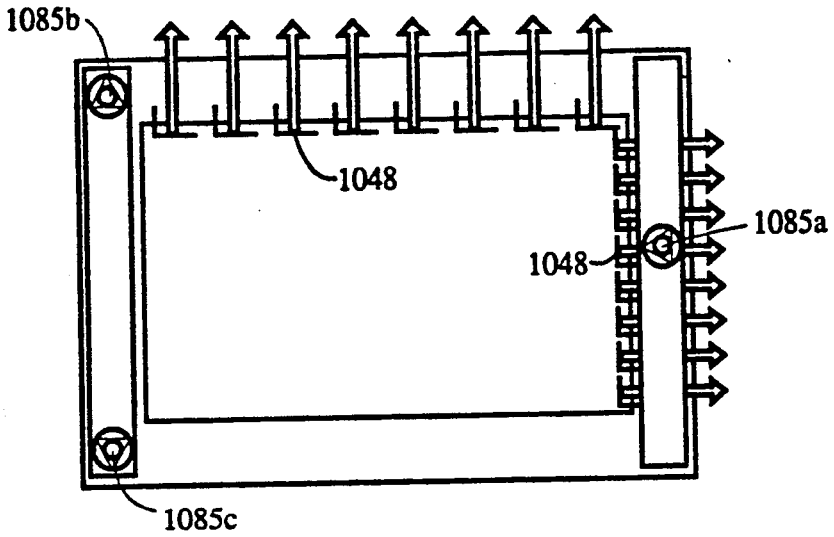
FIG. 8 is a top view of the assembly station of the embodiment of FIG. 2, showing mask interrogation camera array registration features and schematically indicating one half the clamping elements.
Figure 9:
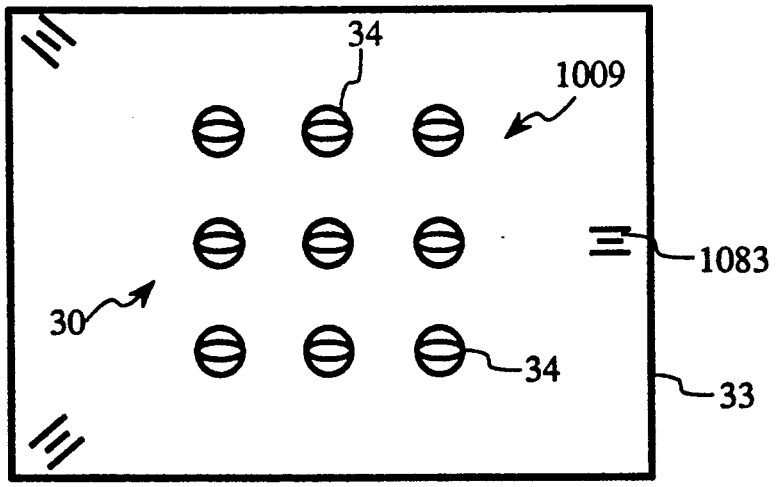
FIG. 9 is a bottom view of the mask interrogation camera array of the embodiment of FIG. 2.

The mask is then stretched and interrogated by mask camera array 1009 for adequacy of the resultant aperture array pattern, and adjusted if necessary. Positional accuracy of the mask camera array 1009 is assured through a three point ball and groove registry system as seen in FIGS. 8 and 9 with grooves 1083 located on the camera array and balls 1085 located on the assembly station 1007 over the stretch clamps 1048, only half of which are shown in FIG. 8.

Figure 7:
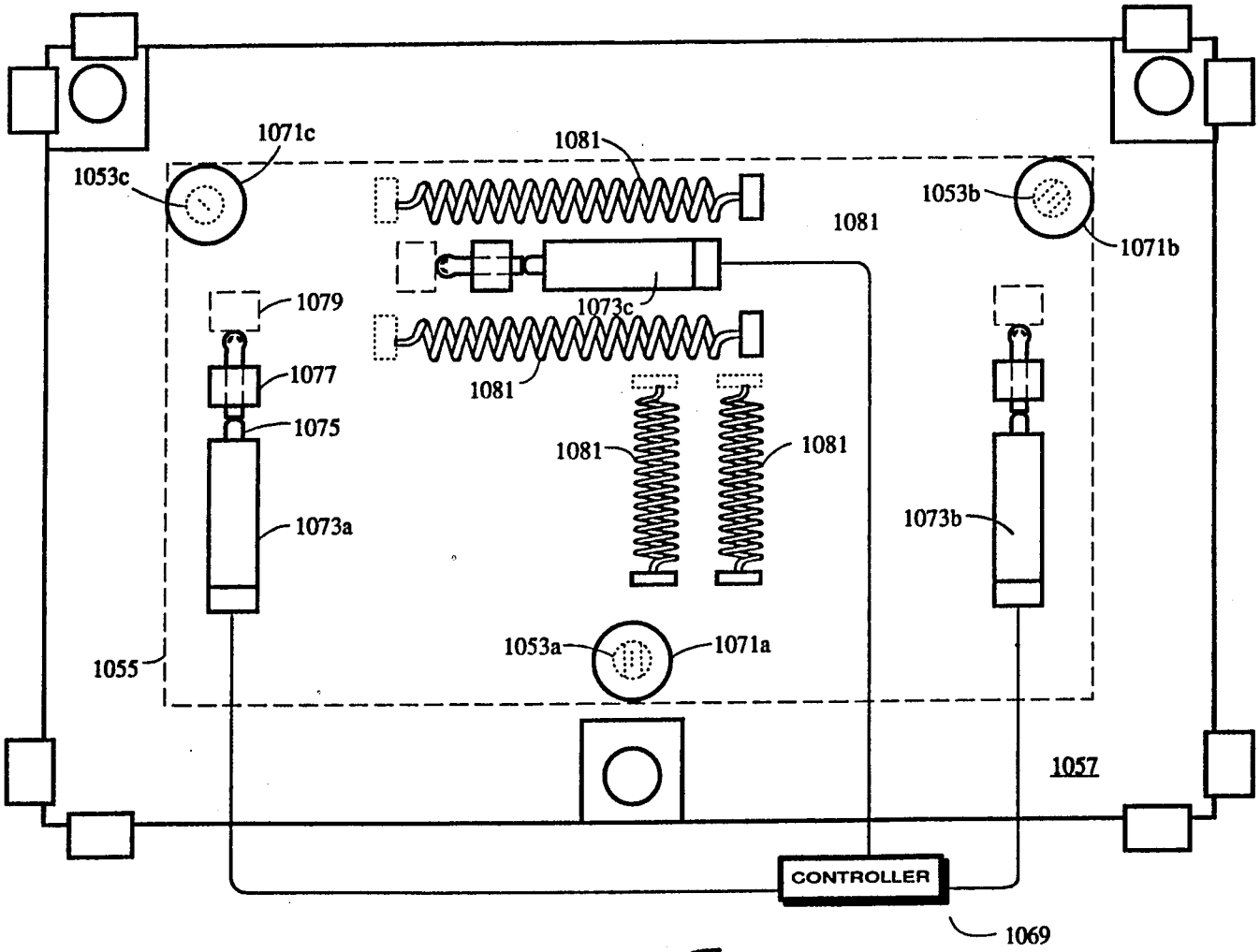
FIG. 7 is a top view of the first and second panel module stages of FIG. 5 with the first stage shown in phantom to present details of the panel positioning elements.

As shown schematically in FIG. 2 and in more detail in FIG. 7, displacement of the screened panel 1049 is accomplished by shifting the panel module first stage 1055 in relation to the panel module second stage 1057, which bears the registry balls 1059 *a,b,c* necessary for positioning the panel module 1005 in the assembly station 1007. The panel module first stage 1055 (FIG. 7 in phantom) is movably mounted on ball bearings 1071 *a,b,c* resting on the panel module second stage 1057.

Stepping motors 1073 *a,b,c* are mounted on the second stage 1057 and have shafts 1075 which contact decoupler pins 1076 supported in bearing blocks 1077 also mounted on the second stage 1057. The decoupler pins 1076 then contact blocks 1079 attached to the underside of the first stage 1055. Controlled activation of the stepper motors 1073 *a,b,c,* will thus exert the motive force required to shift the panel-bearing first stage 1055 in relation to the second stage 1057. The decoupler pins 1076 move only axially within their bearing blocks 1077 in order to provide accurate lateral movement by isolating the movement of the first panel stage 1055 from any distortional side thrust induced by the rotation of stepper motor shafts 1075. Biasing springs 1081 are suitably attached between the first and second stages to maintain the desired position of the first stage 1055.

Thus, the panel interrogation camera array 1011, fixedly positioned on the panel module second stage 1057, can monitor the movements of the panel 1049, feeding position data to the controller 1069, which in turn, directs the movement of the panel module first stage 1055 by controlling the stepper motors 1073 *a,b,c.*

It will be noted here that positioning of the panel first stage 1055 is also used to account for any rotation or offset between the registration component positions of the assembly station and of the panel module. Such offset information may be obtained by placing a calibration plate in the panel module and interrogating the calibration plate position with both the panel camera and mask camera arrays in their respective operating locations and comparing results.

Once the screened panel 1049 is positioned to align with the mask axes in the assembly station 1007, the transport system 1035 transports the panel module 1005 to the assembly station 1007. The panel module 1005 contains fine lifting apparatus identical to the mask module 1003. The gross and fine lifters place the panel rails into contact with the tensed masked. Welding of the mask to the rails is performed by a laser 1089 guided through the controller 1069 by rail information obtained from rail inspection cameras 1083 located in the panel camera array 1011.

Optical interrogation of the mask 12 and screened panel 1049 with microscope video cameras 34 allows the actual location of the fiducial marks placed on the panel, the mask support surfaces, and mask apertures, hereinafter collectively referred to as "objects", to be determined. More processing information is thereby attained than with a simple nulling of an object with an indicator resulting in a greater degree of control over the mask-to-screen registration process. Concurrent transmission and processing of the single bit visual information from each camera allows high operating speeds.

In setting up an optical interrogation system several considerations need to be addressed. For example, the field of view of each camera should be large enough to encompass any expected deviation in the location of the targeted objects, ie., screen fiducial mark or mask apertures. Also, a calibration system must be in place to determine magnification errors and positional reference points to provide a baseline for system operation. A calibration plate having known dimensions and geometry of the targeted calibration apertures or objects may be suitably employed.

Referring again to FIG. 9, the mask aperture interrogation camera array 1009 comprises a mounting plate 33 to which are affixed in known positions nine spaced cameras 34 in a three by three matrix 30. Grooves 1083 are provided on plate 33 for fixed positional reference for placing the array 1009 in a known location. Referring to FIG. 2, the grooves 1083 mate with fixed position balls 1085 *a–c* at the mask inspection station 1007 to locate the array 1083 in a known position.

Referring again to FIG. 6, the panel assembly interrogation camera array 1011 comprises a rectangular platform 46 supporting: four fiducial mark cameras 1067*a*–1067*d* at the midpoint of each platform side; four mask support cameras 1083*a*–1083*d* at the corners of the platform 46, a light 1070 for illuminating the panel assembly, and positioning grooves 1063*a*–1063*c* for placing the camera array 1011 in a known location. As seen in FIG. 2, the positioning grooves 1063 mate with balls 1059 located on the panel assembly inspection station 1005 to provide known positional reference for the panel assembly camera array 1011.

The present invention is concerned in the preferred embodiment with locating the four fiducial marks and nine mask apertures and four mask support or rail-corner locations at production environment speeds so that the mask may be registered to the screen and joined to the rails. The present invention will be described in general example with respect to the location of a fiducial mark. Specific differences in operation as regards mask apertures and rails will be pointed out where necessary to a more thorough understanding.

Figure 10A:
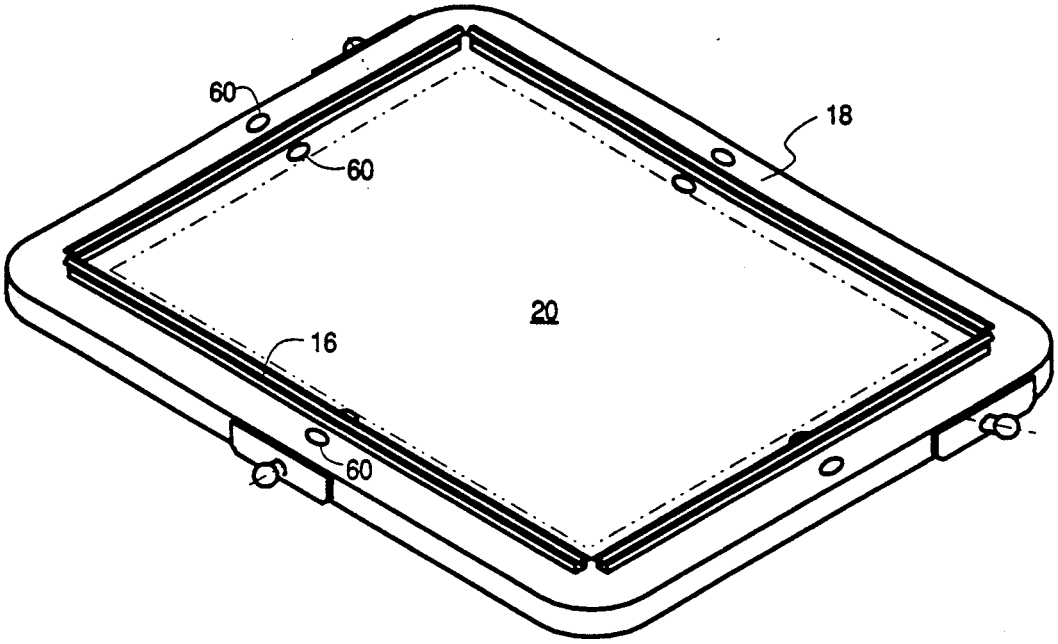
FIG. 10A illustrates a faceplate having mask support structures, or rails, affixed thereto, and screen fiducial marks thereon.
Figure 10B:
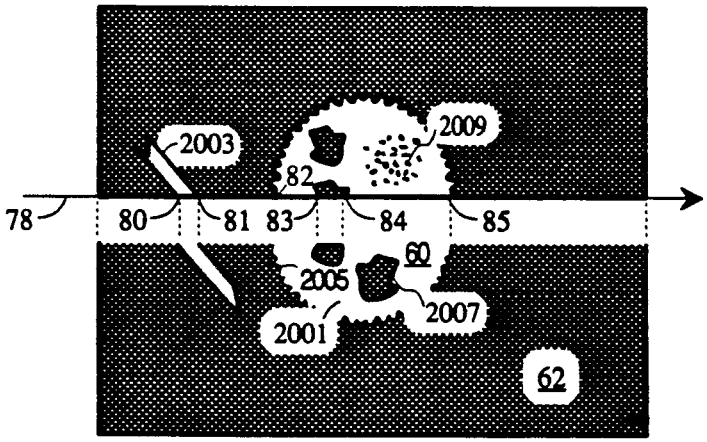
FIG. 10B illustrates the field of view of a fiducial mark panel interrogation camera; the field being split for ease of explanation.

As seen in FIG. 10A a faceplate 18 has fiducial marks 60 located either inside of or outside the rails 16 for screen identification. As seen in FIG. 10B, the fiducial mark cameras will each have a field of view encompassing a fiducial mark 60. The fiducial mark 60 is formed as a light-transmitting aperture in the black grille material 2001 outside of the CRT phosphor screen 20 (FIG. 1) during screen deposition to provide, at least, a positional reference for locating the screen 20 in relation to the faceplate 18. As is known, the screen will be covered with aluminum, making direct observation of it difficult. The fiducial marks are located along each of the mask support structures 16.

A fiducial mark camera 1067 (FIG. 2) will detect light transmitted through, or reflected from, the faceplate glass underlying the black-grille material 62 and create an electronic signal representing the visual information in its field of view. Although analog cameras are described for use with the preferred embodiment, digital output cameras may be suitably used.

Figure 11:
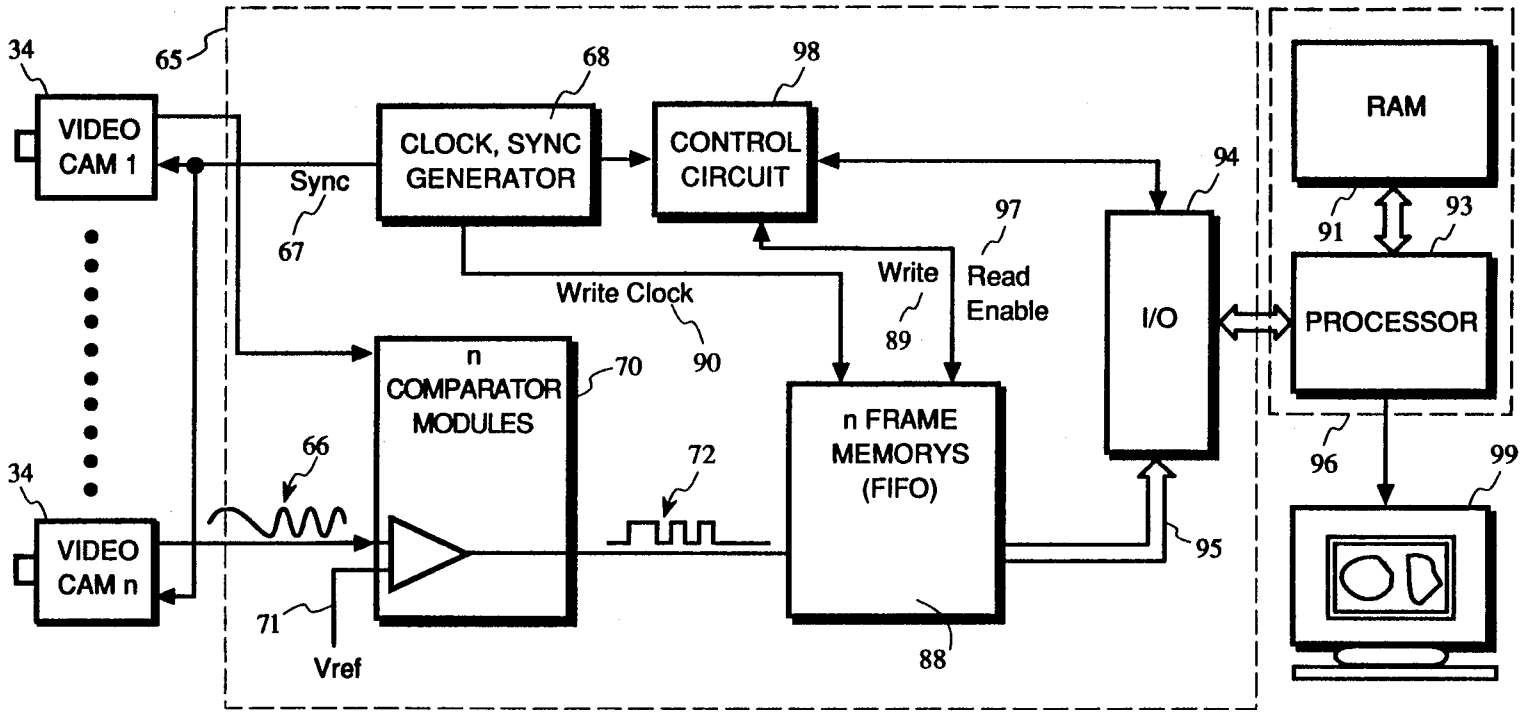
FIG. 11 is a block diagram of the preferred embodiment.

As seen in FIG. 11, the analog output 66 of the camera 34 is then transmitted to a "frame grabber" 65 where the analog camera data is converted to binary form 72 and sampled by write clock pulses in the memory. Thus each sample has a single bit image value and may be thought of as representing a discrete pixel value in the image field. Each camera's like-ordered pixel values are transferred in parallel to a microcomputer 96 for processing.

The microcomputer 96 performs filtering of the visual information to select the targeted apertures 2001 over extraneous scratches 2003 or the like and develops a centroid computation for the aperture 2001. The centroid computation allows for precise measurement of aperture location independent of camera focus and even though the aperture itself may have an irregular outline 2005 and/or contain visual artifacts 2007 or noise 2009 within the aperture outline. This is especially true in the case of the fiducial mark apertures 60 which are formed in the black grille material 62 outside the phosphor deposition area. In such case, the fiducial mark 60 may have artifacts of unremoved grille material 2007 within the aperture. Also, noise 2009 may be present due to the uneven specular reflection of incident inspection light off of the uneven internal antiglare surface of the panel upon which the screen is placed. Such an antiglare surface is described in U.S. Pat. No. 4,884,006, commonly owned herewith. Shadow mask apertures are not nearly as problematic in filtering since they are regularly shaped and present no transmission barrier to the inspection lighting. Mask support rails, being different in form than fiducial mark and mask apertures, present some unique problems, as discussed below.

As seen in FIG. 11, the video cameras 34 , one for each area to be inspected, simultaneously transmit an electronic analog signal 66 containing the visual information from their fields of view to the frame grabber 65. The frame grabber 65 serves to digitize the analog signal 66 in binary form, sample the digitized signal by the write clock signal into discrete pixel values and buffer this pixel information until the computer is ready to process it. Camera resolution is selected based on interrogation needs. The cameras are synchronized to transmit information with a sync command 67 issued by sync generator 68. As each camera's visual transmission path is alike, one will be discussed for simplicity. The analog signal 66 is input to a comparator 70 and compared to a reference voltage 71 set at fifty percent of the maximum analog voltage. The output of the comparator 70 is thus a waveform of binary coded image data 72. The fifty percent reference 71, as further explained below, is selected as a means to accurately digitize slightly defocused images. Converting the visual, or image, information to single bit binary data at this stage obviates the need for frame grabbers utilizing multibit gray-scale encoding for each pixel and allows single bit processing of the visual information, thus increasing processing speed and reducing hardware requirements.

Figure 13:
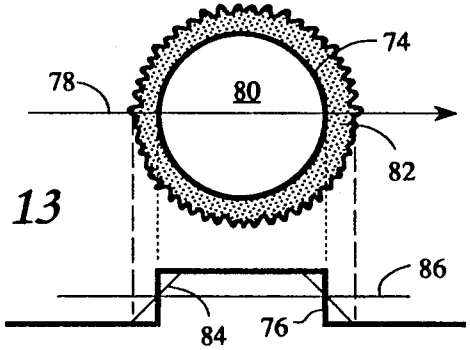
FIG. 13 illustrates the fifty percent threshold of a comparator according to the preferred embodiment.

Referring to FIG. 13, as regards the fifty percent threshold for the comparator, a camera viewing a perfectly focused aperture 74 would produce a square analog wave 76 as the camera scan line 78 traverses the light transmitting portion 80 of the aperture 74. If, however, the aperture 74 is not exactly in the plane of focus of the camera, a defocused image 82 will produce a trapezoidal analog wave 84. At fifty percent of the wave slope the values of the square wave 76 and trapezoidal wave 84 coincide, thus yielding the same binary value from the comparator set at the fifty percent reference voltage 71, thereby compensating for the defocused condition.

Referring again to FIG. 11, the binary video data 72 is input to the frame memory 88 upon issuance of a write signal 89 from the control circuit 98 where it is sampled to provide discrete pixel image data with a write clock 90 and held in a in memory which is used as a first-in/first-out (Fifo) shift register. A OKI Semiconductor chip No. MSM51422RS is suitable for this storage purpose. Thus, the entire camera frame, or field of view, information is represented by single bit binary numbers representing either light or no light image conditions (eg.1=light, 0=no light) for each pixel [coloquially referred to herein as a pixel map]. The frame memory 88 then transfers each camera's pixel map synchronously and in parallel through the I/O gate 94, upon a read enable signal 97 demand from the micro-computer 96.

From the I/O device 94, the corresponding or like-ordered pixel values are transmitted simultaneously in parallel data streams, seen by the computer 96 as bytes 95, to the microcomputer 96, so that each camera's information may be processed simultaneously. The term microcomputer is used to indicate that relatively modest computing power is required for processing the parallel single-bit information stream from each camera in the preferred embodiment. Other forms of digital processing equipment may be used as necessary or desired. The control circuit 98 is connected to the microcomputer 96 through the I/O device 94 and to the frame memory 88 for timing and synchronicity control.

Figure 12:
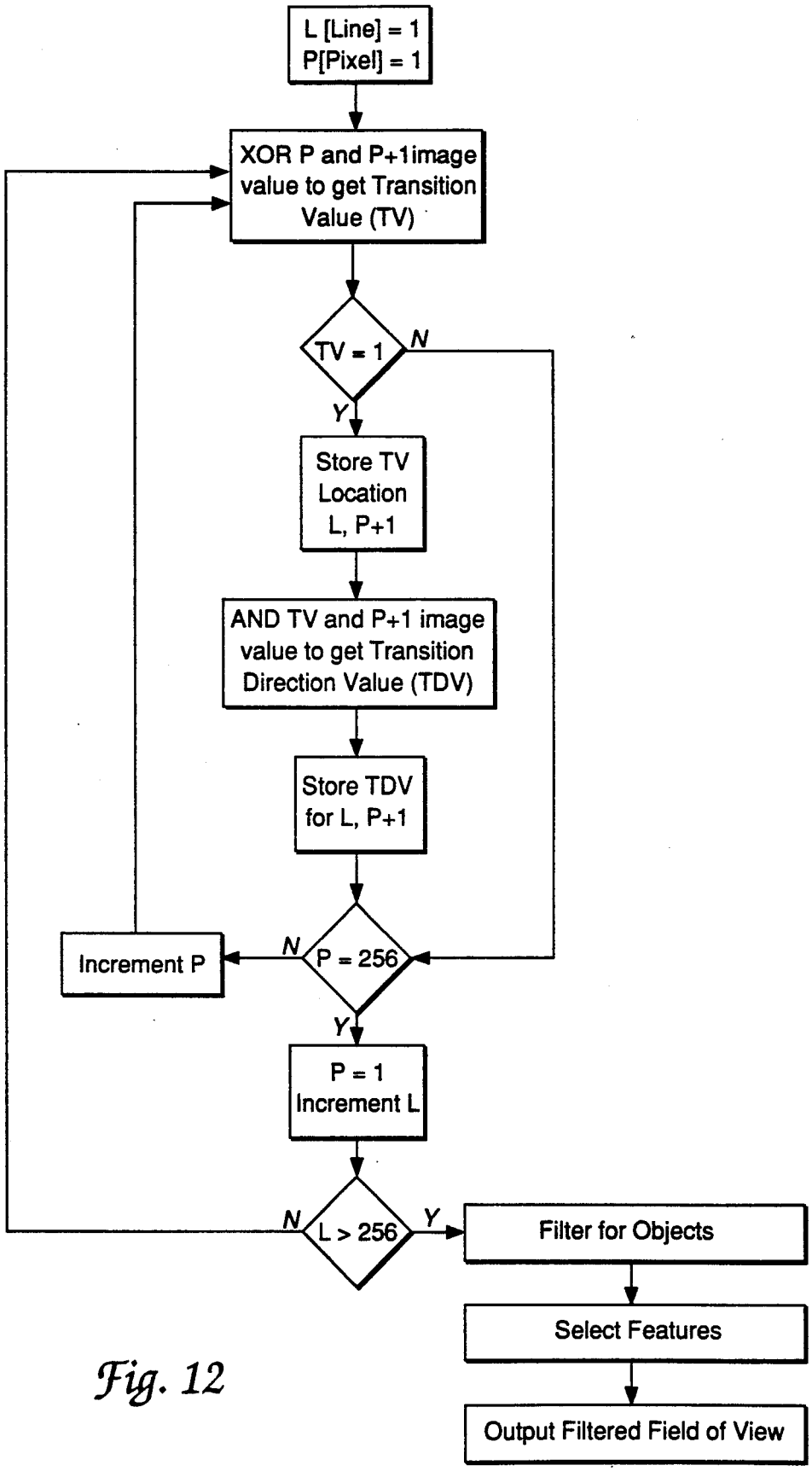
FIG. 12 is a flow chart of image data manipulation within the microcomputer.

Referring to FIG. 12, the micro-computer 96, upon calling for and receiving in its memory 91 the bytes 95 from the I/O device 94, compares the bytes serially in its processor 93 to detect dark/light, ie. light-to-dark or dark-to-light, transitions; filters the transition information to identify desired objects in the camera frame; and marks the object positions with a centroid computation.

As shown in FIG. 12 for a 256 pixel by 256 line resolution matrix, the processor 93 takes the bytes 95, ie., the parallel groupings of like-ordered pixel image values, from the memory 91 and implements algorithms to determine the light/dark transitions in a frame's horizontal scan lines by performing a logical "Exclusive OR" with the current bit, P+1, image value and the previous bit, P, image value on the same line. Thus, a transition value of "1" means a transition has occurred, while a transition value of "0" indicates no transition. Transition direction, ie., dark-to-light 1 or light-to-dark 0, is determined by a logical AND between the current pixel value and transition value. Thus, dark-to-light direction value is 1, and light-to-dark direction value is 0.

Figure 14:
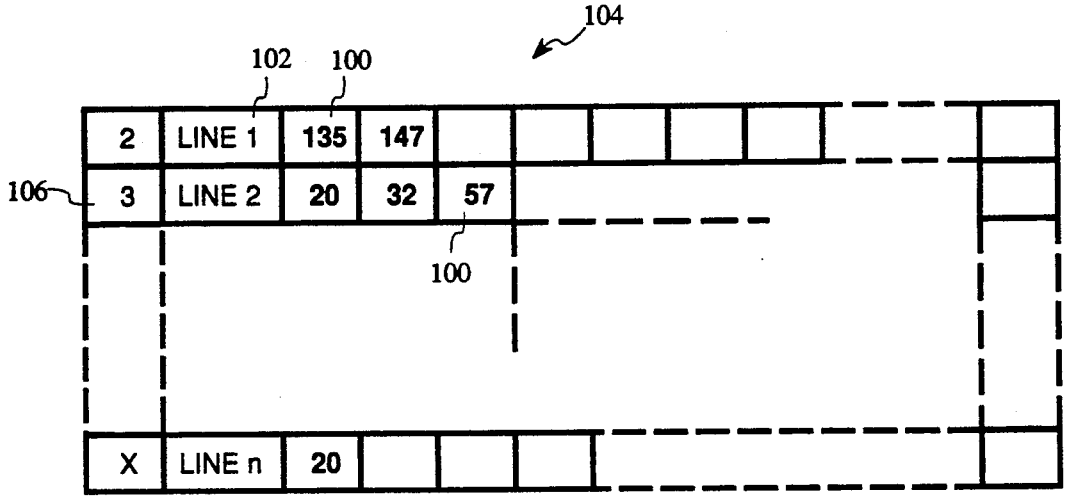
FIG. 14 illustrates a light/dark transition table according to the preferred embodiment.

As seen in FIG. 14, the transition occurrence locations 100, i.e. the pixel number where the transition occurred, are then stored for each horizontal line 102 in the field of view, in the computer memory as a "transition table" 104 for each camera. The transition table 104 also labels each line 102 with the number of transitions 106 therein. Information relating to pixels where no transition occurred is discarded. The transition direction is stored in a separate table. The size of the transition table 104 in the X axis is based on the expected number of transitions within a camera frame. In the Y axis table size is based on the number of horizontal lines in the pixel map.

Filtering of the transition data then takes place in the computer to distinguish noise from objects and to select the desired objects, hereinafter called features, on the panel and mask to be used for registration and attachment of the screen and mask, or other such production processes as are subsequent to an interrogation.

From the transition table 104, the computer 96 will seek a light transmitting length, ie., the number of pixels from a dark-to-light to an light-to-dark direction value (1 to 0) based, for example, on a range of minimum and maximum chord lengths for a circular aperture of known diameter, in this case, the fiducial mark. It will be remembered that the calibrated system knows the distance of each pixel in the field of view. For example, in FIG. 10B, horizontal scan line 78 would detect transitions at points 80–85. However, only the distance from transition 82 (dark-to-light) to transition 85 (light-to-dark) would meet the minimum chord length requirements. Thus, the other 1 to 0 (dark-to-light/light-to-dark) light transmitting lengths, ie. 80–81, 82–83, 84–85, can be ignored, or rejected, as caused by artifacts. Once transition points are selected by chord length, differences in transition location for successive scan lines can be compared to determine whether the aperture conforms to the outline of the desired object. Eg., one and zero transitions should each conform in pattern to a semicircle, with transition locations increasing and then decreasing in a regular pattern from the top down. If they do not conform to the tolerance set for the object pattern the aperture is rejected. Also, the area of an aperture (or light transmitting area) can be figured and a minimum area criteria can be set based on the known area of a desired object. As an aperture is being selected as an object during the filtering process its centroid is being concurrently computed. The centroid can then be compared to a table of desired values, e.g. relative or absolute positional values; to select one object in the field as the desired feature therein where necessary for further processing. The selected feature and its centroid are then identified and stored by camera number and XY location in a feature table. This information may then be displayed in human readable form on a video monitor 99.

Figure 15:
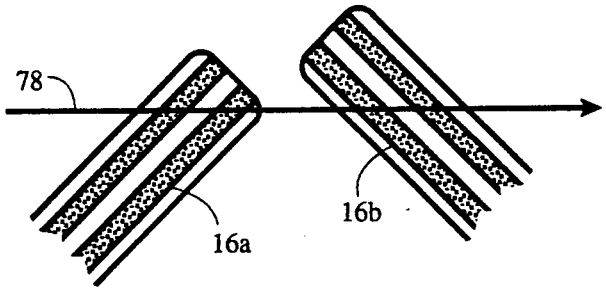
FIG. 15 illustrates the field of view of a mask support rail interrogation camera.
Figure 16:
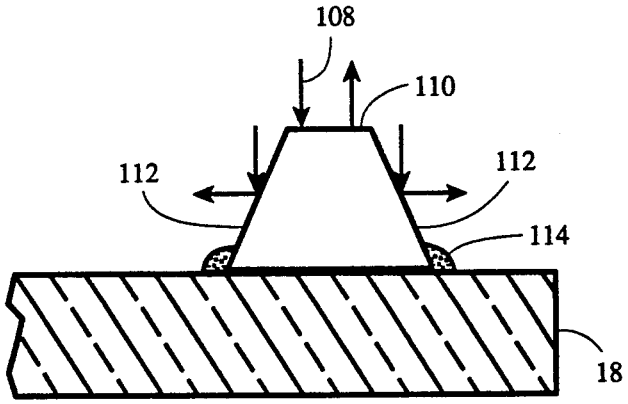
FIG. 16 illustrates the illumination of a mask support rail according to the preferred embodiment.

In the case of the rails 16 as seen in FIG. 15, one rail camera 50 *a–d* (FIG. 4) can be used to scan two perpendicular rails 16*a*, 16*b* at their adjacency to identify mask-welding and cutting tracks thereon. The rail cameras, it will be realized, must have a wider field of view than the mask and fiducial mark cameras. It will be understood that the tensed mask is ordinarily welded o the center line of the rail top surface 110 (FIG. 16) and then trimmed outwardly therefrom with a laser as discussed in U.S. Pat. No. 4,891,546, commonly owned herewith. The camera scan line 78 is directed across both rails 16*a,b* at a forty-five degree angle to provide the sharpest scan angle for both rails for the determination of reflected light transitions. As seen in FIG. 16, top lighting 108 will be reflected upwardly back to the camera off of the rail top surface 110 which is metal and has been ground in preparation for welding of the mask 12 (FIG. 1) thereto. Light incident upon the rail sides 112 will be deflected outwardly and not be picked up by the camera. Devitrified solder glass, or frit 114, used to attach the rails 16*a, b* to the faceplate 18 may parallel the rails top surface 110 and reflect light back to the camera. A dark colored frit may be used to minimize this possibility. Alternatively, filtering algorithms or a human operator may select from multiple centerlines of light transmitting segments meeting rail top surface criteria.

While a particular embodiment of the invention has been shown and described, it will be readily apparent to those skilled in the art that changes and modifications may be made in the inventive means and process without departing from the invention in its broader aspects. For example, it will be readily appreciated that the present invention may be used for a variety of inspection tasks in the CRT manufacturing environment such as mask or grille inspection. The inspection may then be combined with other subsequent manipulative apparati such as means for automatic rejection of the inspected part or means for curing the defect, such as the mask and screen defect remover described in U.S. Pat. No. 4,871,415, (commonly owned herewith) with modification of the filtering algorithms to retain data on plugged or malformed apertures. Therefore, the aim of the appended claims is to cover all such changes and modifications a fall within the true spirit and scope of the invention.

What is claimed is:

1. An apparatus for interrogating at least one CRT workpiece, comprising;

a) a plurality of video cameras placed in known locations, the cameras each having a field of view on at least one CRT workpiece;

b) means for representing each field of view as a series of pixels;

c) means for valuing each pixel in a single-bit image value;

d) processor means for serially comparing each camera's series of pixel image values in parallel to determine where transitions take place between pixel image values for each camera;

e) means for filtering the transition locations to determine where desired features in the fields of view occur.

2. The apparatus according to claim 1 wherein the means for representing each field of view in claim 1 (b) includes:

means for synchronizing each camera's operation.

3. The apparatus according to claim 1, further comprising: means for manipulating the workpiece in response to the determinations of the processing and filtering means.

4. The apparatus according to claim 3 wherein the means for manipulating includes means for moving a CRT shadow mask and a CRT faceplate towards registry.

5. The apparatus according to claim 4 wherein the means for moving towards registry further includes means for affixing the mask to a faceplate mounted mask support to form a faceplate assembly.

6. In the manufacture of CRTs a system for registering undedicated flat tension masks to phosphorescent screens deposited on CRT front panels, comprising:

(a) an assembly station where the mask and panel are joined together;

(b) a mask module for supporting the mask for transport to the assembly station;

(c) a panel module for supporting the panel for transport to the assembly station;

(d) module registration means at the assembly station for locating serially the mask module and the panel module;

(e) interrogation means for interrogating the mask and the panel to determine the locations of the desired features of the mask and panel, including:

1.) a spaced array of video cameras, each camera located in a known position and each producing a video signal electronically representing its field of view;

2.) means for sampling the signal to provide a series of pixels; each pixel having a single bit image value;

3.) means for parallel grouping of like-ordered pixel image values from each camera's pixel series into one or more bytes; and 4.) means for serially comparing the bytes to simultaneously determine, for each camera, the locations of transitions between its pixel image values; and, (f) movement means for producing registration movement between the mask and panel, the movement means being responsive to the interrogation means.

7. A method of interrogating at least one CRT workpiece, comprising:

(a) positioning a plurality of cameras in known positions;

(b) viewing at least one CRT workpiece with the plurality of cameras thereby establishing a field of view for each camera;

(c) electronically representing the field of view of each camera as a series of pixels;

(d) assigning each pixel a single-bit image value;

(e) serially comparing each camera's series of pixel image values in parallel to determine where transitions take place between pixel image values for each camera;

(f) processing the transition locations to determine where desired features in the fields of view occur 8. A method of registering and assembling a CRT faceplate assembly including a shadow mask and a screened panel comprising:

(a) placing an array of video cameras in known position to view the panel and the shadow mask;

(b) simultaneously viewing the shadow mask and the panel with the cameras thereby producing from each camera a video signal electronically representing the field of view of each camera;

(c) dividing each signal into a series of pixels each having a single bit image value;

(d) grouping like-ordered binary pixel image values, from the pixel series of each camera, in parallel into one or more bytes;

(e) serially comparing bytes to simultaneously determine the locations of transitions between the pixel image values for each camera; and, (f) registering and joining the panel and the shadow mask according to the locations determined.

9. The method according to claim 8 further comprising: determining the direction of the transitions as being light-to-dark or dark-to-light.

10. The method according to claim 9 further comprising storing the locations and directions of the transitions in a memory means.

11. The method of claim 10 further comprising;

processing the locations and directions of the transitions to determine physical parameters of objects on the mask, or panel, or both.

12. The method of claim 10 further comprising;

storing the locations and directions of the transitions in memory tables for each camera.

13. The method of claim 11 further comprising;

selecting a desired feature from among the objects and storing its location.

14. The method of claim 13 further comprising;

determining the centroid of the feature to identify the feature location.

15. An apparatus for simultaneous optical interrogation of a plurality of fields on CRT shadow mask and screened faceplate comprising;

a) two spaced arrays of video cameras, one array viewing the shadow mask and one array viewing the faceplate, each camera located in a known position and producing a video signal electronically representing its field of view;

b) means for dividing each signal into a series of pixels;

c) means for valuing each pixel of each signal in a single bit image value;

d) means for grouping like ordered pixel image values from each camera in parallel into one or more bytes; and, e) means for serially comparing the bytes to simultaneously determine the locations of transitions in the pixel image values for each camera.

16. The apparatus of claim 15 further comprising means for determining the direction of the transitions in the pixel image values.

17. The apparatus of claim 16 further comprising;

means for storing the locations and directions of the pixel image value transitions.

18. The apparatus of claim 17 further comprising;

means for processing the locations and directions of the pixel value transitions to determine physical parameters of the inspected objects.

19. The apparatus of claim 18 further comprising means for selecting a feature from the physical parameters of the inspected objects and, means for identifying and storing the feature location.

20. The apparatus of claim 19 further comprising;

means for determining the centroid of the feature to identify the feature location.

21. The apparatus of claim 18 further comprising;

means for displaying the physical parameters in human readable form.

22. The apparatus of claim 15 wherein the means for valuing each pixel further comprises: means for comparing the video signal to a reference voltage, which is substantially fifty percent of the maximum video signal voltage, to produce a binary signal.

23. The apparatus of claim 15 wherein the means for dividing each signal into a series of pixels further comprises means for creating a binary digital signal for each camera and dividing each binary signal into a desired number of pulses constituting pixels.

* * * * *